United States Patent [19]

Imai et al.

[11] Patent Number: 4,814,129

[45] Date of Patent: Mar. 21, 1989

[54] PROCESS FOR PRODUCING STABILIZED YARN FOR PRODUCING CARBON FIBER

[75] Inventors: Koichi Imai; Hideo Izumichi, both of Tokyo, Japan

[73] Assignee: Nikkiso Co., Ltd., Tokyo, Japan

[21] Appl. No.: 872,645

[22] Filed: Jun. 12, 1986

[30] Foreign Application Priority Data

Jun. 14, 1985 [JP] Japan ..... 60-129420

[51] Int. Cl.[4] ..... D02J 13/00

[52] U.S. Cl. ..... 264/83; 264/85; 264/29.2; 264/290.5; 264/290.7; 264/234; 264/345; 264/40.1

[58] Field of Search ..... 264/29.2, 83, 85, 290.5, 264/290.7, 234, 345, 40.1

[56] References Cited

U.S. PATENT DOCUMENTS 4,100,004 7/1978 Moss et al. ..... 264/29.2
4,534,919 8/1985 McAliley et al. ..... 264/29.2
4,609,540 9/1986 Izumi et al. ..... 264/29.2

FOREIGN PATENT DOCUMENTS 61-75819 4/1986 Japan .

*Primary Examiner*—Jan H. Silbaugh
*Assistant Examiner*—Hubert C. Lorin
*Attorney, Agent, or Firm*—Browdy and Neimark

[57] ABSTRACT

A process for producing a stabilized yarn for producing a carbon fiber is disclosed. It includes a step for thermally stabilizing a yarn by travelling a continuous fiber through the heated inside of a thermal stabilization furnace. The yarn stabilizing step is characterized in that a tension applied to the continuous fiber at a final stage of stabilizing process is higher than that applied to the continuous fiber at an initial stage of stabilizing process. An apparatus for carrying out the process is also disclosed. According to the present invention, a thermal stabilization fiber having a higher strength and a finer radius can be produced.

3 Claims, 2 Drawing Sheets

PROCESS FOR PRODUCING STABILIZED YARN FOR PRODUCING CARBON FIBER

BACKGROUND OF THE INVENTION

This invention relates to a process for producing a stabilized yarn for producing a carbon fiber and a thermal stabilization furnace for carrying out the process.

In a conventional industrial process for producing a carbon yarn, in order to obtain sufficient time for thermally stabilizing a continuous fiber in a furnace for producing a thermally stabilized yarn (hereinafter simply referred to as "thermal stabilization furnace"), the thermal stabilization furnace is provided with a number of rollers which are arranged either inside or outside thereof, so that the continuous yarn may travel through the furnace in a zig-zag manner, i.e., the yarn proceeds to the first roller, makes a U-turn at the first roller, travels back to the inside of the furnace, proceeds to a second roller located at the opposite side of the first roller, takes a U-turn, travel backs to the inside of the furnace and repeats this zig-zag trip.

On the other hand, in order to obtain a high strength carbon fiber, the continuous fiber must be applied with a tension while it is in a stabilizing process. In addition, it is also required that there occur no damage, fluffing, cutting of the continuous fiber, when it travels on such arranged rollers.

In order to meet with these requirements, the present applicant has proposed an invention under Japanese Patent Application No. 59(1984)-195923 which aims at preventing the occurrence of damage, fluffing, etc. on the continuous fiber. The feature of the proposed invention is in that a tension applied to the continuous fiber travelling within a thermal stabilization furnace is held constant.

Although the invention under the Japanese Patent Application No. 59(1984)-195923 can surely produce a stabilized yarn hardly susceptible to fluffing and yarn cutting, and yet having somewhat high strength, today's demand is for producing an even higher strength carbon fiber.

In order to produce a high strength carbon fiber, it is required to apply as much tension as possible to a continuous fiber and obtain a stabilized yarn having a fine radius. To this end, a larger tension, for example, near the tensile strength disclosed in the specification accompanied to the afore-mentioned Japanese Patent Application must be applied to the continuous fiber. If a tension larger than break strain is applied, there occurs as a matter of course a breakage of the continuous fiber, thereby disenabling to obtain a stabilized yarn which is higher in strength and finer in radius than the yarn described in the specification of the afore-mentioned Japanese Patent Application.

SUMMARY OF THE INVENTION

It is therefore an object of the present invention to provide an improved and novel process for producing a stabilized yarn for making a carbon fiber having a fine radius and high strength and a thermal stabilization furnace for satisfactorily carrying out the process.

In order to achieve the above object, there is essentially provided a process for producing a stabilized yarn for producing a carbon fiber including a step for thermally stabilizing a yarn by travelling a continuous fiber through the heated inside of a thermal stabilization furnace, whereby the yarn stabilizing step is characterized in that a tension applied to the continuous fiber at a final stage of stabilizing process is higher than that applied to the continuous fiber at an initial stage of stabilizing process.

There is also provided a thermal stabilization furnace including a first tension control means disposed at one end of the furnace from where a thermal stabilization processing starts and a second tension control means disposed at the other end of the furnace where the thermal stabilization processing finishes, both being adapted to control a tension applied to a continuous fiber during a thermal stabilization processing, whereby the furnace further including at least one tension variable means for increasing the tension applied to the travelling continuous fiber.

The present invention is accomplished based on the following finding which was found as a result of a hard study made by the inventors of the present application.

That is, a continuous fiber was caused to travel within a thermal stabilization furnace while maintaining the tension constant, and sample fibers were taken out at several portions between the inlet and the outlet of the furnace and the elongations thereof were measured. The elongation of the fiber taken out in the vicinity of the inlet was approximately 0 (fiber was broken when stretched), while the elongation of the fiber in the vicinity of the outlet had some value. This fact shows that in the latter half portion of the travelling path within the furnace, there still remains room to apply a higher tension to the continuous fiber to improve its strength.

The above and other objects, features and advantages of the present invention will become apparent to those skilled in the art from the following detailed description of the embodiments of the present invention, when taken in conjunction with the accompanying drawings, wherein:

DETAILED DESCRIPTION OF THE PREFERRED EMBODIMENTS

Figure 1:
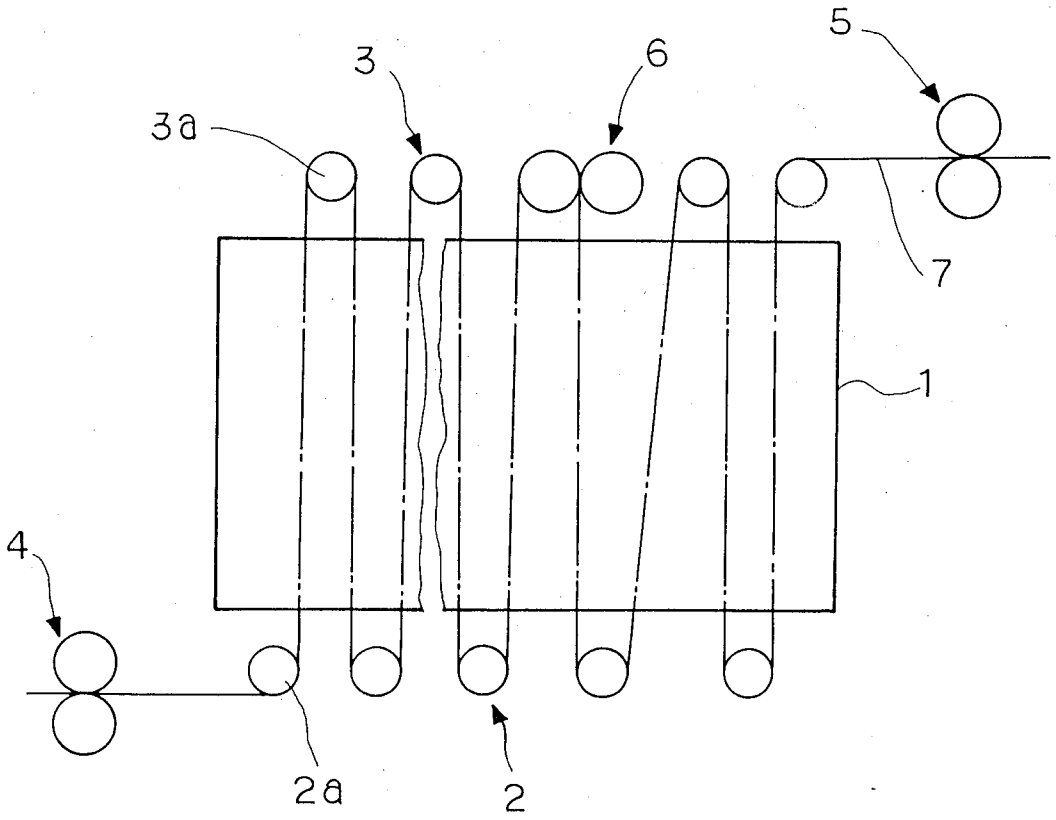
FIG. 1 is a schematic view for explaining the constitution of the present invention.

For better understanding of the present invention, reference is had to FIG. 1, in which a thermal stabilization furnace 1 includes a first and a second free roller groups 2 and 3 arranged along the outer sides of the furnace 1 in the longitudinal direction in such a manner as to hold the furnace 1 therebetween, a first tension control means disposed at a vicinity of an inlet port of the furnace from where a continuous fiber 7 starts travelling, a second tension control means disposed at a vicinity of an outlet port of the furnace where the fiber stops travelling, and at least one tension variable means 6 disposed at the outer sides of the furnace at an intermediate place on a continuous fiber travelling path extending from the inlet port to the outlet port.

The continuous fiber 7 starts travelling from the inlet port. After passing through the first tension control means 4, the continuous fiber 7 enters into the inside of the thermal stabilization furnace 1 through, for example, the first free roller 2*a*, then travels to the outer side of the furnace 1 at the other side thereof, makes a U-turn at the second free roller 3*a* and then enters again into the inside of the furnace 1. In this way, the continuous fiber 7 reciprocally travels within the thermal stabilization furnace 1 while repeating the U-turn between the first free roller group 2 and the second free roller group 3. Then, the fiber 7 passes through the tension variable means, reciprocally travels within the thermal stabilization furnace 1 while making U-turns between the first free roller group 1 and the second free roller group 3 again and again, and finally passes through the second tension control means 5.

The tension of the fiber is decided by a speed ratio of the tension control means 4,5 and the tension variable means 6, and controlled by making the speed ratio variable.

An important matter of the present invention is in that in a thermal stabilization processing step, a tension applied to the continuous fiber 7 at a final stage of the thermal stabilization processing is higher than that applied to the fiber 7 at an initial stage of the thermal stabilization processing. Accordingly, in the thermal stabilization furnace 1 according to the present invention, it is important that the tension decided by the tension variable means 6 and the second tension control means 5 is controlled to be higher than that decided by the first tension control means 4 and the tension variable means 6.

In this embodiment, the continuous fiber 7 may include organic fibers such as, for example, polyacrylonitrile based organic fiber, organic polymer based fibers such as rayon, polyvinylalcohol, polyacetylene, aramide, polymide, etc.; and fibers based on a polycyclic polynuclear aromatic compound having a comparatively low molecular weight as represented by pitch, etc., furfuryl alcohol or an initial polymer having a suitable viscosity obtained by mixing furfural to this and heating. Of them, the polyacrylonitrile based fiber, i.e., PAN is particularly preferable.

Suitable examples of the first tension control means 4 and the second tension control means 5 may include a nip roller, a tension bar, etc. If an occurrence of yarn cutting is taken into consideration, a preferable example of the tension control means is a nip roller.

Further, one preferable example of the tension variable means 6 is a nip roller.

The tension variable means 6 is disposed somewhere on the fiber travelling path between the first tension control means 4 and the second tension control means 5. The number of the tension variable means 6 is not necessarily limited to only one. Instead, a plurality of tension variable means 6 may be employed. However, if the established conditions of the first control means 4, the second tension control means 5 and the tension variable means 6 are taken into consideration, the sufficient number of the tension variable means 6 is four or so at the most. Usually, only one tension variable means 6 is used.

When the polyacrylonitrile based fiber is used as the continuous fiber 7 and only one tension variable means 6 is used, the tension variable means 6 is preferably disposed to a position where the continuous fiber 7 needs at least two reciprocal trips, and more preferably 3.5 reciprocal trips. The preferable position of the tension variable means 6 is not necessarily limited to the above position, since it may vary depending on various factors such as kinds of the continuous fiber 7, the number of the first free roller group 2 and the second free roller group 3. The preferable position of the tension variable means 6 may be decided through testing everytime such a necessity arises.

The tension (A) decided the first control means 4 and the tension variable means 6, when the polyacrylonitrile based fiber is employed, is usually 1 to 8 kg/mm$^2$ and preferably 2 to 5 kg/mm$^2$. And, the ratio (B)/(A) decided by tne first tension control means 4 and the and the tension variable means 6 and the tension (B) decided by the tension variable means 6 and the second tension control means 5, when the polyacrylonitrile based fiber is employed, is usually 1.1 to 2 and preferably 1.2 to 1.5. If the ratio (B)/(A) is smaller than 1.1, it is often not preferable since the strength increase of the carbon fiber becomes insufficient. On tne other hand, if the ratio (B)/(A) is larger than 2, it is again often not preferable since there occur fluffing, winding of the fluff around the rollers, yarn cutting, etc. The range of the ratio (B)/(A) is variable depending on the kinds of the continuous fiber 7. Accordingly, it would be appreciated that the range of the ratio (B)/(A) can be easily decided through testing.

The temperature for heating the thermal stabilization furnace 1 employed in the process according to the present invention and the thermal stabilization furnace 1 according to the present invention, when the polyacrylonitrile based fiber is employed as the continuous fiber 7, is usually 180° to 350° C., and preferably 220° to 280° C. Further, the inside temperature of the thermal stabilization furnace 1 is not necessarily constant. On the contrary, in order to prevent a fusion of the fiber and shorten a processing time of thermal stabilization, the temperature in the vicinity of the inlet of the thermal stabilization furnace is preferably set to be lower than that in the vicinity of the outlet thereof. The ranges of preferable temperatures in the vicinities of the inlet and the outlet are different depending on kinds of the continuous fiber. In the case a polyacrylonitrile based continuous fiber is employed, the temperature in the vicinity of the inlet of the thermal stabilization furnace is preferably set to be 240° C. or less, and the temperature in the vicinity of the outlet is preferably set to be 250° C. or more.

Figure 2:
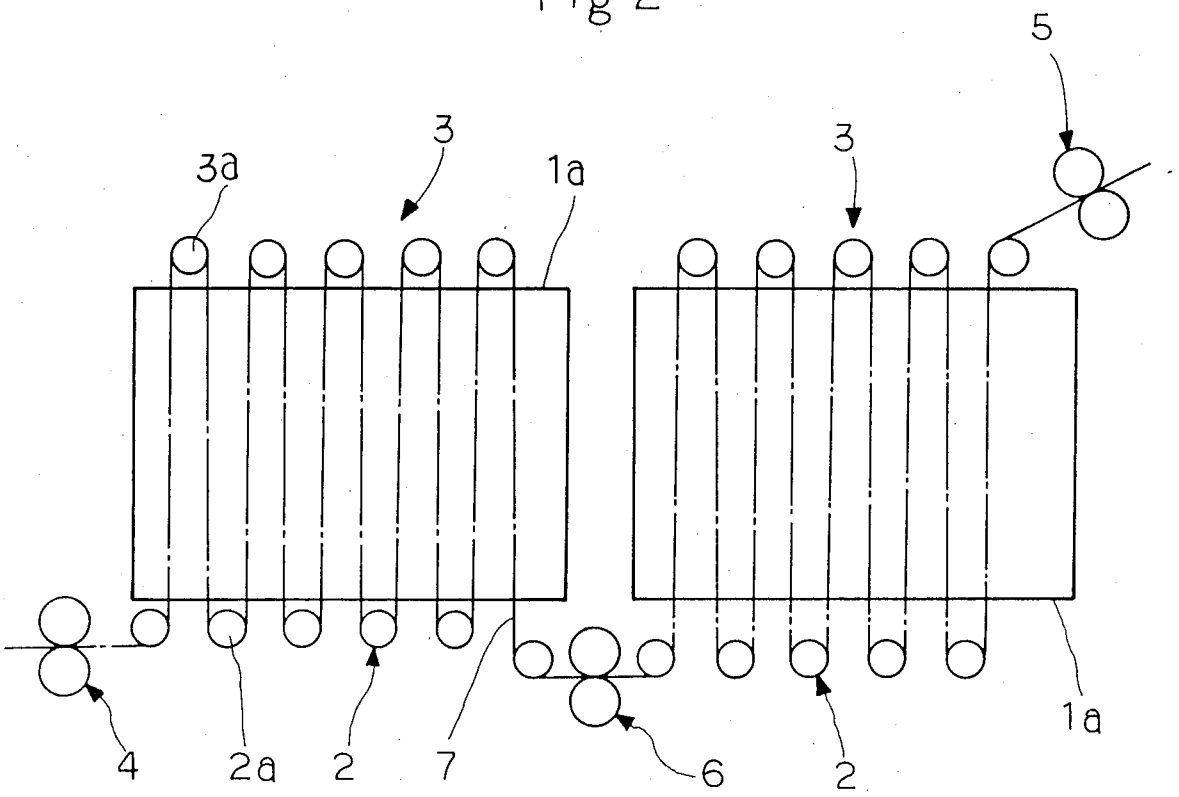
FIG. 2 is likewise a schematic view for explaining a modified embodiment of the present invention.

In short, the temperature within the thermal stabilization furnace is set in such a manner as to be gradually increased from the inlet toward the outlet, and preferably by dividing it into three steps or more stepwise. For example, as shown in FIG. 2, the thermal stabilization furnace may be comprised of a first thermal stabilization furnace 1*a* and a second thermal stabilization furnace 1*b*. In this case, the tension variable means 6 is disposed somewhere in the midway of the travelling path of the continuous fiber 7 between the first thermal stabilization furnace 1*a* and the second thermal stabilization furnace 1*b*.

Degree of the thermal stabilization is preferably as such that an oxygen content in the fiber is 6 to 10%, specific gravity of the fiber is 1.25 to 1.45%, or that when a lighter test is carried out, even if a flame spreads to the thermally stabilized yarn, it is extinguished in a few seconds.

The oxygen content is obtained based on difference of oxygen contents between the thermally stabilized yarn and the organic fiber by elemental analysis.

The lighter test is made in such a manner as that a flame of a lighter is approached to a fiber which is generally horizontally stretched and a judgement is made on whether the flame spreads.

Needless to say, this thermal stabilization processing may be carried out in air or inert gas such as nitrogen or the like. In any case, the vicinity of the outlet of the thermal stabilization furnace is preferably provided with a nitrogen containing gas atmosphere.

As described in detail in the foregoing, according to a process of the present invention and a thermal stabilization furnace 1 of the present invention, an oxidizing reaction and/or a cyclization reaction proceeds while the continuous fiber 7 travels within the thermal stabilization furnace 1. Besides, the continuous fiber 7 is applied with a higher tension than that of the start of the thermal stabilization processing during its travel.

According to a process of the present invention, since the tension applied to the continuous fiber at the final stage of the thermal stabilization processing is controlled to be higher than that applied to the continuous fiber at the initial stage of the thermal stabilization processing, there can be obtained a thermally stabilized fiber having a much finer radius and a higher strength than that which is obtained through a conventional thermal stabilization processing wherein a constant tension is applied to the continuous fiber. Accordingly, when a thermally stabilized fiber obtained by this method is carbonized, a carbon fiber having a highr strength and a finer radius can be obtained.

Further, according to a thermal stabilization furnace according to the present invention, there can be obtained a thermal stabilization furnace which is simple in construction and yet can preferably carry out the process according to the present invention. In addition, as described in the foregoing, a thermal stabilization fiber habing a high strength and a much finer radius than that obtained through a thermal stabilization processing wherein a constant tension is applied to the continuous fiber and a high strength.

Next, the present invention will be described in greater detail with reference to the following examples.

EXAMPLE 1

A thermal stabilization furnace used herein was constructed as such that in FIG. 1, eight pieces of first rollers each having a diameter of 15 cm are arranged at the bottom side, while eight pieces of second rollers each having a diameter of 5 cm are arranged at the ceiling side, a first nip roller having a surface speed of 22 cm/min. as a first tension control means is arranged at one end of the thermal stabilization furnace from where the thermal stabilization processing starts, while a second nip roller having a surface speed of 35 cm/min. as a second tension control means is arranged at the other end of the thermal stabilization furnace from where the thermal stabilization processing is finished, at the same time, instead of a fourth roller of a second free roller, a third nip roller having a surface speed of 27 cm/min. as a tension variable means is arranged, effective height of the thermal stabilization furnace being 0.7 m, the inside of the furnace being divided into four chambers by partition panels, the temperatures of the respective furnace chambers being set as 220° C., 240° C., 260° C. and 280° C. from the first nip roller side. And, polyacrylonitrile based fibers (filament number 3000, filament radius 8.5 μm, gravity 1.18, strain 20%) obtained by copolymerizing a 2% of methylacrylate and a 1% of itaconic acid were hang in ten strings and caused to travel within the thermal stabilization furnace. The fiber tension by the first nip roller and the third nip roller was 760 g, while the fiber tension by the second nip roller was 950 g.

Such obtained thermal stabilization fibers were flowed at the rate of three minutes stay time through the carbon furnace of 1350° C. temperature filled with a pure nitrogen while applying a 100 g of tension, and a carbon fiber was produced. The strength of such obtained carbon fiber was 565 $Kg/mm^2$, the radius of the carbon fiber was 3.8 μm and the fluffing of the fiber was 1.3 piece/m.

The strength of the fiber was measured according to the strand method of JIS R 7601 and the radius of the fiber was measured according to the fiber concentration method of the same JIS.

COMPARISON

The same thermal stabilization furnace as employed in the above-described Example 1 was used except that the third nip roller was not used, the first nip roller was 22 cm/min in surface speed, and the second nip roller was 30 cm/min. in surface speed. And, the thermal stabilization processing was carried out under the conditions that the same polyacrylonitrile based fiber was used, the fiber was hang in ten and the fiber tension was constantly maintained 760+30 g within the thermal stabilization furnace.

Such obtained thermal stabilization fiber was carbonized in a carbon furnace in the same manner as the afore-mentioned Example 1 and a carbon fiber was obtained. The strength of such obtained carbon fiber was 513 $Kg/mm^2$, the radius of the fiber was 4.2 μm, and the fluffing thereof was 1.2 pieces/m.

From the results described in Example 1 and the Comparison, it can be seen that according to the present invention, a thermal stabilization fiber for producing a carbon fiber having a finer radius and a higher strength can be produced.

While specific embodiments of the present invention have been shown and described in detail to illustrate the application of the principles of the present invention, it will be understood that the present invention may be embodied otherwise without departing from such principles.

What is claimed is:

1. A process for producing a thermally stabilized yarn for producing a carbon fiber, including a step for thermal stabilizing a yarn by passing a continuous fiber through a heated interior of a thermal stabilization furnace, said step of thermal stabilization comprising:

continuously feeding an organic fiber into a thermal stabilization furnace through a first nip roller positioned outside a fiber inlet of said furnace;

moving said fiber from said inlet, through said furnace, along a sinusoidal path, by passing said fiber reciprocatingly about exterior free rollers arranged along ceiling and bottom sides of said furnace and a second nip roller exterior to said furnace along the ceiling or bottom side of said furnace, said exterior free rollers being positioned along said fiber path between each said first nip roller and said second nip roller and between said second nip roller and a third nip roller positioned outside of a fiber outlet of said furnace;

removing said fiber from said furnace through said fiber outlet by passing said fiber through said third nip roller;

controlling the tension (B) of the fiber between said second and said third nip roller to be greater than the tension (A) between said first nip roller and said second nip roller; and controlling the temperature within said furnace to gradually increase from said inlet toward said outlet.

2. A process according to claim 1 wherein the ratio (B)/(A) of the tension(B) of the fiber between said third nip roller and said second nip roller and the tension (A) of the fiber between said second nip roller and said first nip roller is 1.1–2.

3. A process according to claim 1 wherein the organic fiber comprises polyacrylonitrile.

* * * * *